US007134938B2

(12) United States Patent
Grijpstra

(10) Patent No.: US 7,134,938 B2
(45) Date of Patent: Nov. 14, 2006

(54) SYSTEM, DEVICE AND METHOD FOR CUTTING STEEL PLATE

(76) Inventor: Martinus Grijpstra, Schelphorst 59, NL-1771 SM Wieringerwerf (NL)

( * ) Notice: Subject to any disclaimer, the term of this patent is extended or adjusted under 35 U.S.C. 154(b) by 0 days.

(21) Appl. No.: 10/514,816

(22) PCT Filed: May 14, 2003

(86) PCT No.: PCT/NL03/00354

§ 371 (c)(1),
(2), (4) Date: Apr. 28, 2005

(87) PCT Pub. No.: WO03/097301

PCT Pub. Date: Nov. 27, 2003

(65) Prior Publication Data

US 2005/0176352 A1 Aug. 11, 2005

(30) Foreign Application Priority Data

May 17, 2002 (NL) ..... 1020622

(51) Int. Cl.
*B26D 5/08* (2006.01)

(52) U.S. Cl. ..... 451/36; 451/75; 83/53; 83/177

(58) Field of Classification Search ..... 451/41, 451/75, 36, 63, 38, 99, 101, 102; 83/177, 83/53, 54, 76.1
See application file for complete search history.

(56) References Cited

U.S. PATENT DOCUMENTS 4,700,596 A * 10/1987 Taguchi ..... 83/13
4,949,611 A * 8/1990 Fillion ..... 83/221
5,385,311 A * 1/1995 Morikawa et al. ..... 241/266
5,431,350 A * 7/1995 Purser ..... 241/101.72
5,676,490 A * 10/1997 Nelson ..... 404/94
5,782,673 A * 7/1998 Warehime ..... 451/2
6,077,152 A * 6/2000 Warehime ..... 451/75

* cited by examiner

*Primary Examiner*—Jacob K. Ackun, Jr.
(74) *Attorney, Agent, or Firm*—Harness, Dickey & Pierce, P.L.C.

(57) ABSTRACT

A system for cutting steel plate, in particular for cutting the bottom and/or the wall of an oil storage tank, comprising a hydraulic or pneumatic pump and a movable cutting device comprising a hydraulic or pneumatic motor for moving the cutting device, wherein the pump and the motor are hydraulically or pneumatically interconnected by means of hoses.

20 Claims, 4 Drawing Sheets

SYSTEM, DEVICE AND METHOD FOR CUTTING STEEL PLATE

The invention relates to a system for cutting steel plate, in particular for cutting the bottom and/or the wall of an oil storage tank. Although the invention will be described in relation to the cutting of steel plate, and in particular to the cutting of the bottom and/or the wall of an oil storage tank, the invention can also be used for cutting other materials.

An oil storage tank as used in the oil-processing industry, for example, is generally built up of a steel, disc-shaped bottom plate, a steel wall and the roof, which may or may not be vertically movable. Corrosion and wear make it necessary to replace the plate members in whole or in part on a regular basis. To that end, the plate members in question are cut out and removed, after which new plate members are welded in position in or over the hole. So far, said cutting out has been carried out by means of cutting torches wielded by skilled workers who enter the storage tank, to which end they first cut a hole in the wall of the (empty) storage tank in many cases.

A major drawback of this method is the fact that the work is tiring for the workers, but above all this method potentially constitutes a significant health hazard. Not only may the prolonged inhalation of residual oil vapours in the storage tank cause damage to the workers' health, but in addition there is a direct risk of explosion. Frequently, jet flames and explosions occur in the storage tank when this method is used. Consequently, regulations prescribe that the workers carry out the work in sturdy protective clothing.

Consequently, there is a need for a system for cutting steel plate which is less hazardous to the workers' health, and/or which renders the removal of steel plate members simpler and/or cheaper.

To that end the system comprises a hydraulic or pneumatic pump and a movable cutting device comprising a hydraulic or pneumatic motor for moving the cutting device, with the pump and the motor being hydraulically or pneumatically interconnected by means of hoses. The cutting device can thus move independently through the oil storage tank, possibly guided and operated by an operator, whilst the pump is disposed outside the tank. Since no sparks or flames are caused by the motor inside the oil tank, the risk of jet flames and explosions occurring is minimised. The device may also be adapted for operation by remote control, or it may carry out the cutting operation entirely in accordance with a preprogrammed control programme, so that the presence of an operator in the tank is not required, which further enhances the safety level.

The cutting device preferably comprises at least one nozzle for squirting an abrasive liquid under high pressure against and through the plate. This manner of cutting through plate helps to further reduce the risk of explosion.

The nozzle is preferably supported by at least one wheel, which can travel over the steel plate. It is important that a precisely defined spacing be maintained between the nozzle and the plate in the case of abrasive cutting. The nozzle is preferably spring-connected to the driven portion of the cutting device. In this way the wheel is urged into contact with the plate under all circumstances, and any irregularities in the plate, such as weld seams, do not stand in the way of obtaining a regular cut in the plate.

The cutting device is preferably fitted with two spaced-apart nozzles, in such a manner that the cutting device is capable of cutting a strip from the steel plate in one movement. Furthermore preferably, the cutting device comprises a container for an abrasive agent.

A regular and precisely defined velocity of movement is very important, since otherwise the plate might not be fully cut through at some points. To that end the cutting device is fitted with caterpillar tracks for moving the device. Moreover, the transmission ratio between the motor and the wheels is such that the velocity of movement of the device will preferably be less than 0.5 m/s, more preferably less than 0.1 m/s, even more preferably less than 0.06 m/s, with an engine speed of about 3000 rpm or a hydraulic output of about 25 l/min.

The invention also relates to a cutting device for cutting steel plate, in particular for cutting the bottom and/or the wall of an oil storage tank, comprising at least one nozzle for squirting an abrasive liquid under high pressure against and through the plate, and a motor for moving the cutting device. In this simple embodiment of the invention, the motor may be any type of motor, for example an electric motor or a combustion motor. Preferably, however, a hydraulic or pneumatic motor is used for cutting the bottom or the wall of an oil storage tank, which motor is hydraulically on pneumatically connected, by means of hoses, to a separate hydraulic or pneumatic pump disposed outside the tank.

The invention furthermore relates to a method for cutting the bottom and/or the wall of a storage tank, wherein a cutting device is moved over the bottom of the storage tank by means of a motor during the cutting operation. Preferably, said cutting is effected by squirting an abrasive liquid under high pressure against and through the bottom and/or the wall. The abrasive liquid preferably contains stand and/or garnet. Furthermore, the cutting device is preferably hydraulically or pneumatically driven, to which end a hydraulic or pneumatic pump is disposed outside the storage tank, which pump is connected to the motor.

In a special embodiment of the method according to the invention, the cutting device abuts against the wall of the storage tank while moving through the storage tank, with the wall acting as a guide for the cutting device. In this way, the bottom is cut loose from the wall in one operation. In order to enable the removal of the loose bottom from the tank, it will be necessary to cut the loose bottom into strips, which strips can subsequently be removed through an opening in the wall.

The invention will now be explained in more detail by means of an embodiment as shown in the Figures, in which.

Figure 1:
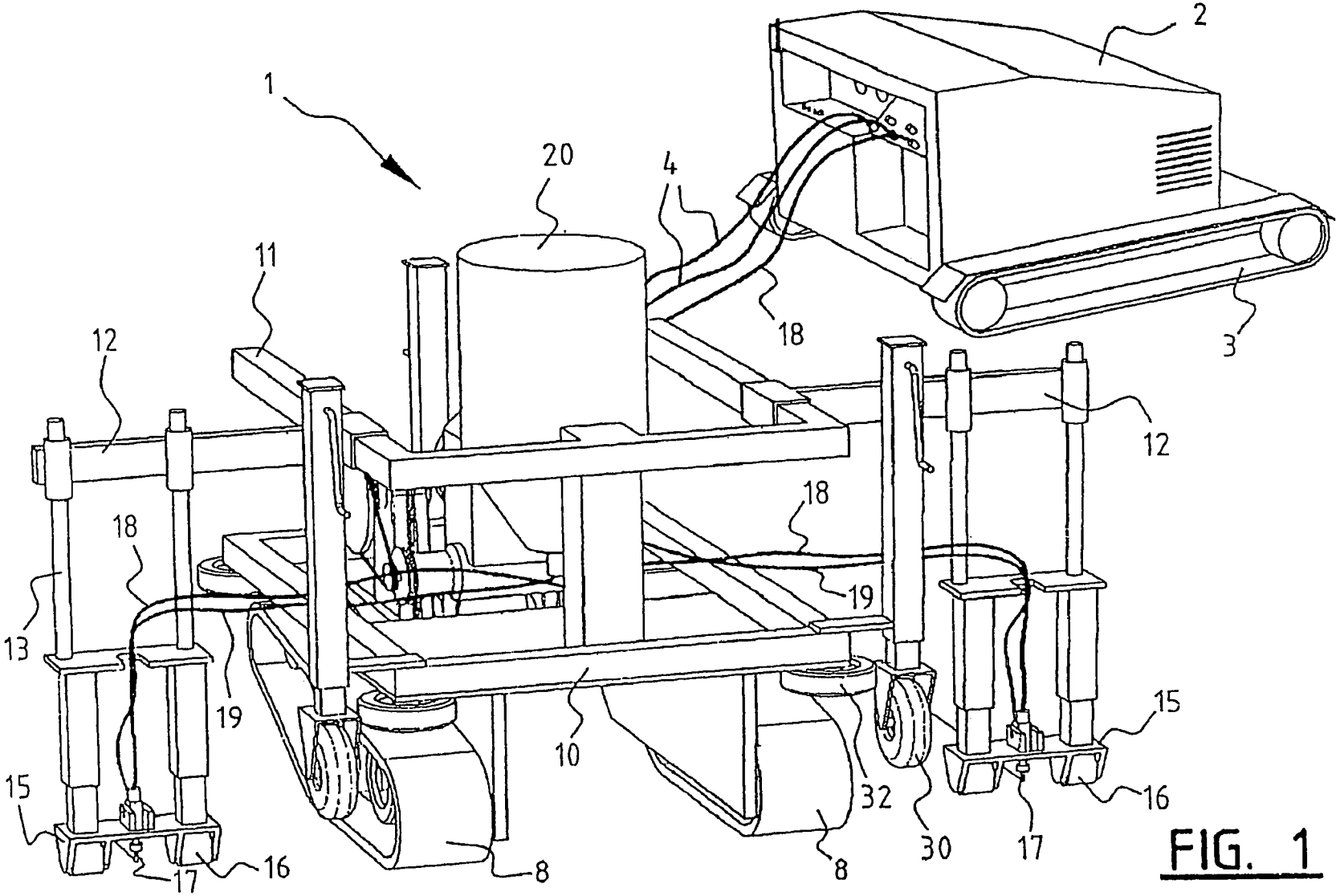
FIG. 1 is a perspective view of a system for cutting steel plate, which comprises a cutting device and a hydraulic pump unit.
Figure 2:
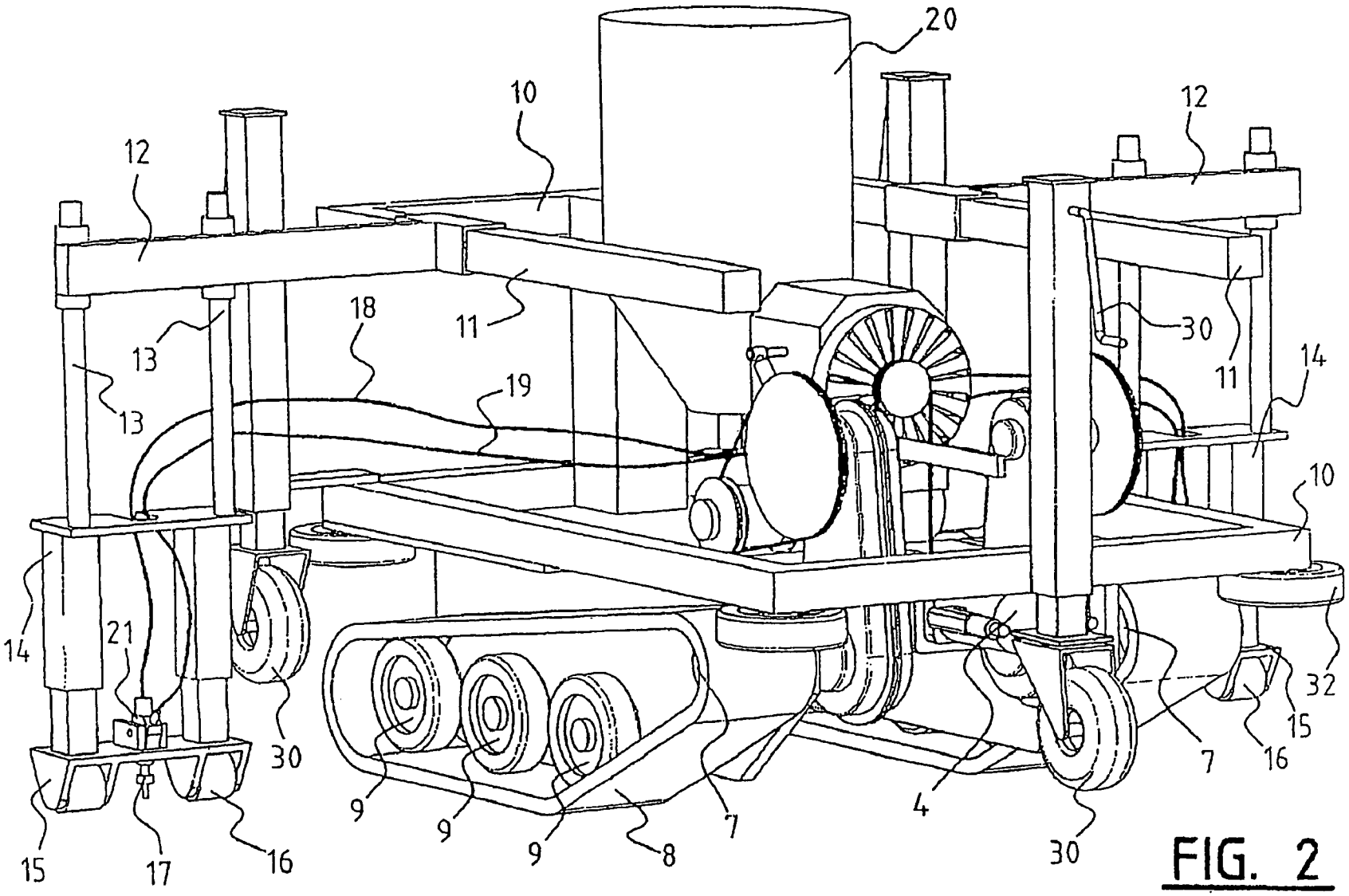
FIG. 2 is a perspective view of the cutting device that is shown in FIG. 1.

According to FIGS. 1 and 2, a system for cutting steel plate comprises a cutting device 1 and a hydraulic pump device 2. The hydraulic pump device 2 is provided with caterpillar tracks 3, which make it mobile. The pump device 1 is connected, via hoses, to a hydraulic motor 4 that functions to drive the cutting device 1, which motor 4 is to that end provided with hydraulic connections 5, 6 (see FIG. 3). The front wheels 7 of the cutting device 1 are driven via a transmission, which will be discussed with reference to FIG. 3. Caterpillar tracks 8 are passed over the driven wheels 7, which tracks are further tensioned by idle wheels 9.

The motor 4, the transmission and the wheels 7, 9 are all mounted on a frame 10.

The frame 10 comprises two beams 11 extending in the direction of movement, substantially along the entire length of the cutting device 1, on which beams two laterally extending arms 12 are movably mounted.

Rods 13 extend downwards from said arms 12, to which rods travelling gears 15 are connected by means of telescopic spring mechanisms 14. The travelling gears 15 each comprise two wheels 16, between which a nozzle 17 is suspended. During operation, the wheels 16 are pushed against the surface to be cut by the telescopic spring mechanism 14, with a predetermined constant spacing being maintained between the nozzle 17 and said surface. Said spacing will generally range from 2 to 10 mm.

The nozzle 17 is connected to a high-pressure water source, for example a pump device 2, by means of a hose 18, and to the container 20 by means of a hose 19. In use, the container 20 is filled with an abrasive agent, such as sand or garnet, which is sucked into a mixing chamber 21 of the nozzle 17 as a result of a sub-atmospheric pressure prevailing therein, in which mixing chamber it is mixed with the water. Said mixture is thus squirted against and through the surface to be cut, during which operation the cutting device is moved ahead at a constant velocity of movement. The water pressure must generally be set at a level of 500–4000 bar, depending on the thickness of the material and the type of material.

Figure 3:
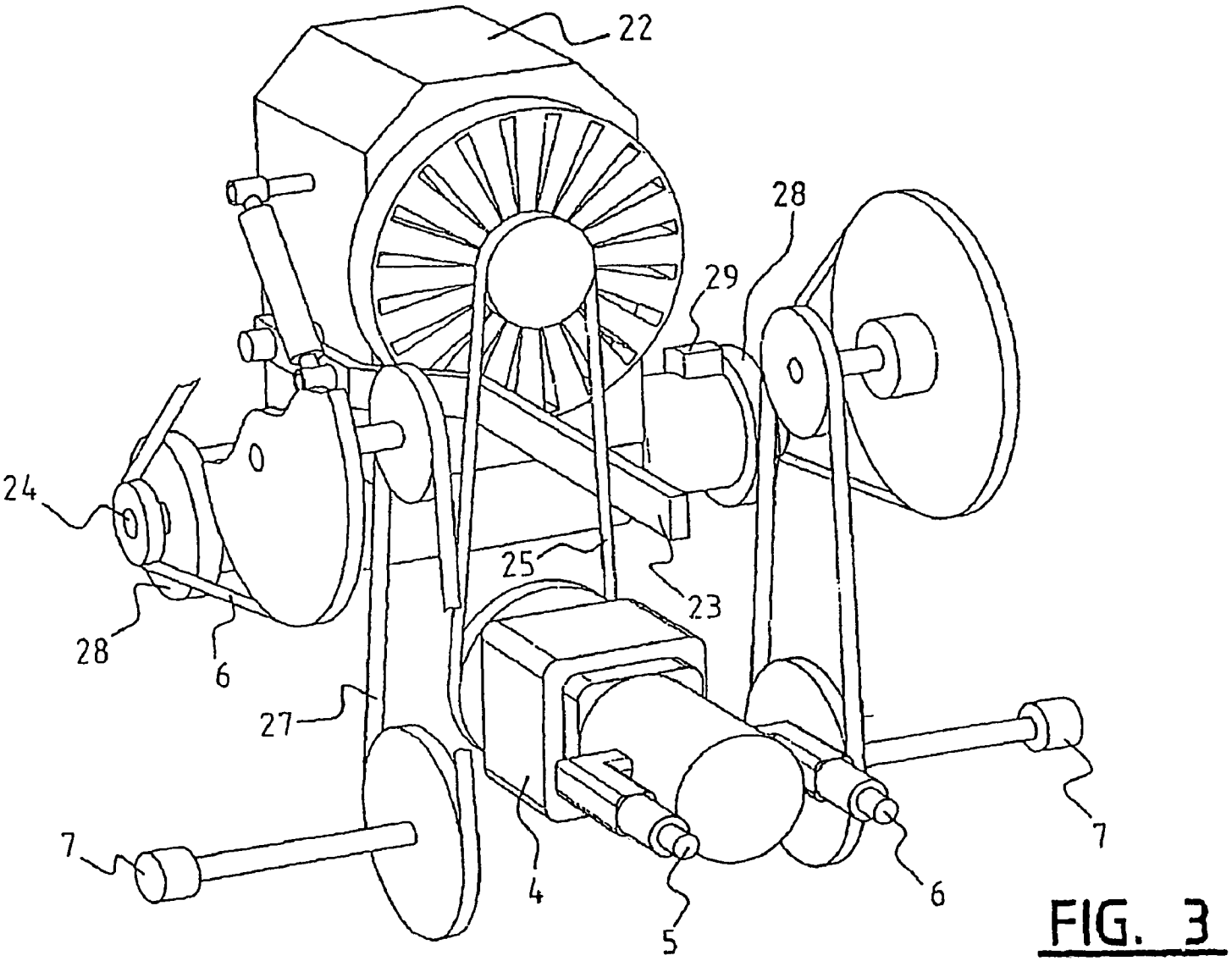
FIG. 3 is a perspective view of a detail of the cutting device that is shown in FIG. 2.

According to FIG. 3, the transmission between the hydraulic motor 4 and the driven wheels 7 comprises a continuously variable transmission mechanism 22, which is connected to the hydraulic motor 4 by means of a driving belt 25. The transmission mechanism 22 can be controlled by means of a control rod 23, by means of which both the velocity of movement and the direction of movement of the cutting device 1 can be set.

The driven shafts-24 are connected to the transmission mechanism 22 via a controlled slip differential 28, which differential can be locked by means of a control button 29, so that a straight line of movement of the device can be maintained in use. This latter aspect is important in connection with any irregularities in the surface over which the device 1 is being moved. The driven shafts 24 are connected to the driven wheels 7 by means of two further driving belts 26, 27.

The dimensions of the transmission 2 have been selected such that the velocity of movement of the cutting device 1 is maximally about 5.5 cm/s with a hydraulic output of the hydraulic motor 4 of 25 l/min at about 3000 rpm of said motor. The pressure being delivered by the hydraulic pump device 2 is about 60 bar in that case.

Because the velocity of movement of the cutting device 1 is too low for moving the device quickly between two working places, the device 1 is provided with three castors 30 that can be moved by means of a crank 31 to such an extent that the caterpillar tracks 8 as well as the travelling units 15 are lifted clear of the surface and the device 1 can be moved manually. Furthermore, the frame 10 of the device 1 is provided with horizontally rotating guide wheels 32 in the corner points, whose function will be explained with reference to FIG. 4*b*.

Figure 4B:
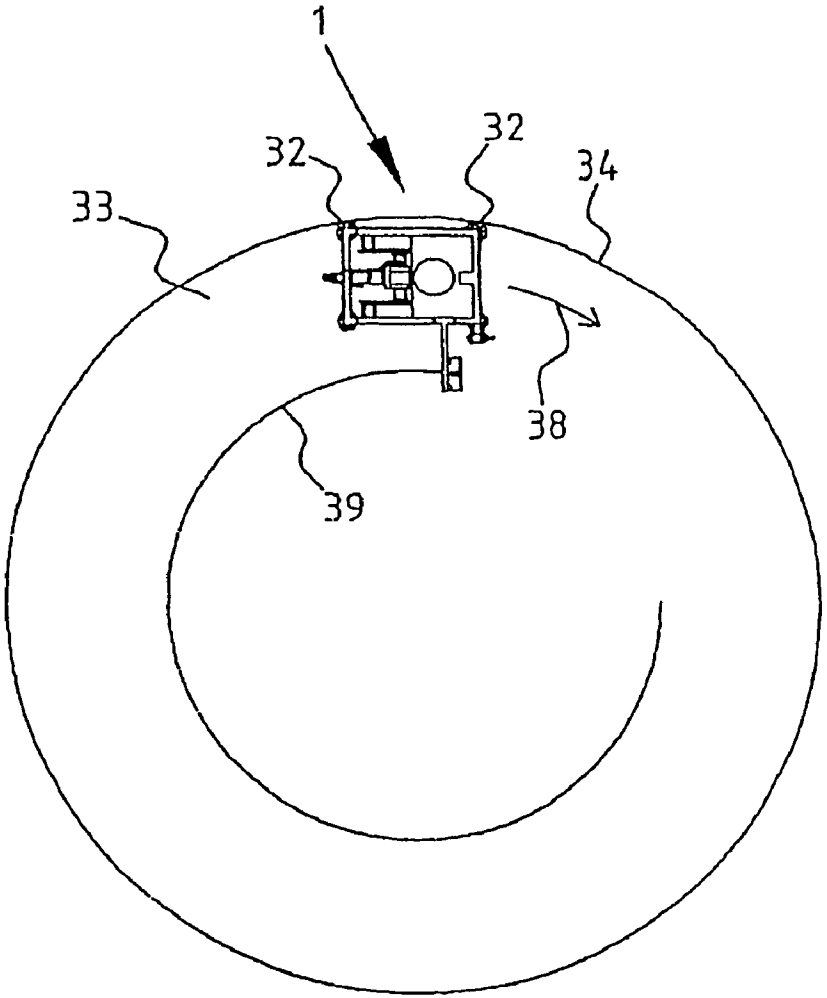
FIGS. 4*a* and 4*b* are schematic views of a bottom of an oil storage tank and a cutting device.
Figure 4A:
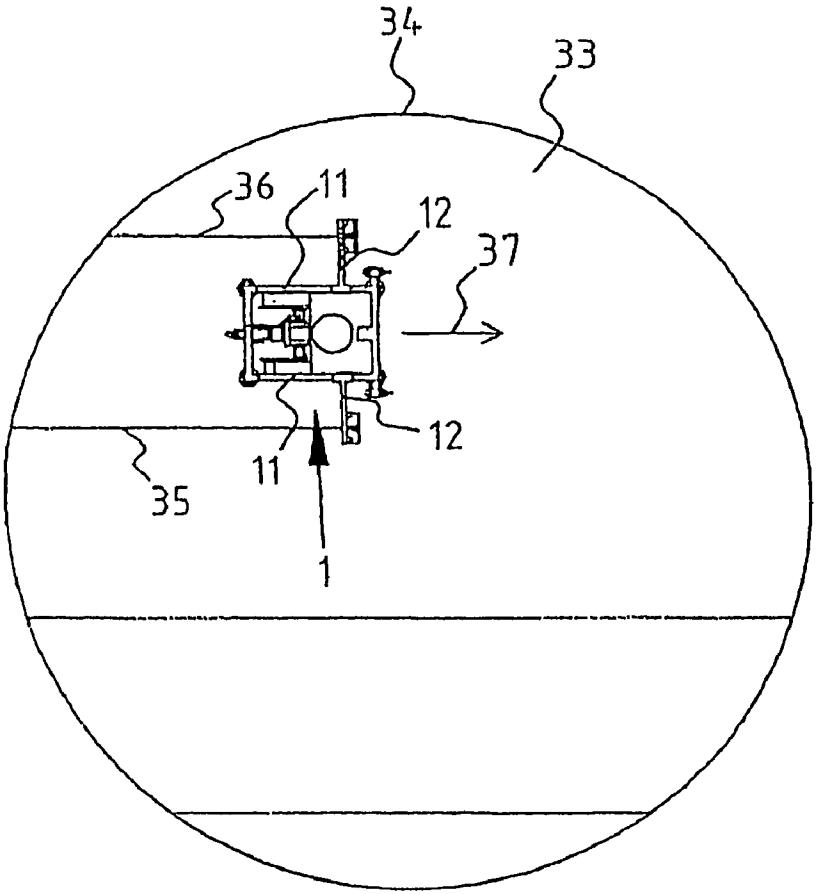

FIG. 4*a* shows in schematic, top plan view the manner in which a bottom plate 33 of an oil storage tank is cut into strips by a cutting device 1. The pump device 2 (not shown) is disposed outside the oil storage tank, and it is connected to the cutting device 1 by means of the hoses 4, 18. The cutting device 1 is positioned against the wall 34 of the tank with its front or rear side for the purpose of cutting a strip from the bottom 2. The two arms 12 are moved over the beams 11 to a position as close to the wall 3 as possible, after which the pump device 2 is put into operation, causing the cutting device to move slowly away from the wall 3. At the same time, the high pressure water pump is put into operation, and a start is made with the cutting of the bottom plate 2 along the lines 35, 36. Once the cutting device 1 has moved a sufficient distance away from the wall 3, it is moved back over a distance corresponding to the length of the cutting device 1, and the arms 12 are moved entirely to the front over the beams 11. The device 1 is set going again, and the strip is cut out in its entirety in the direction indicated by the arrow 37, until the opposite side is reached.

FIG. 4*b* shows how the device 1 can be used for cutting the bottom loose along a circular line along the wall 34. This may be done after or before the cutting of the strips as shown in FIG. 4*a*. In order to do so, one of the two arms 12 and the nozzle 17 connected therewith are removed, and two of the horizontally rotating guide wheels 32 present on one side of the device 1 are placed into abutment with the wall 34. When the cutting device is now set moving in the direction indicated by the arrow 38, and the water containing the abrasive agent is squirted through the remaining nozzle 17, the bottom 33 will be cut through along the line 39. It should be considered that FIGS. 4*a* and 4*b* are not drawn to scale, and that in practice the dimensions of the cutting device 1 are much smaller when compared to the cross-sectional dimension of the bottom 33, so that only a relatively narrow strip will remain along the wall 34.

The device 1 that is shown in the Figures comprises a frame 10 which is made in one piece. In order to be able to move the device 1 through a small opening in the oil storage tank, however, it is preferred to use a frame assembled from detachable parts, so that the cutting device 1 can be inserted into the storage tank in small parts and subsequently be assembled therein.

Although this is not shown in the Figures, the cutting device may also be provided with a hydraulic lift, on which a nozzle 17 is mounted. Said lift can be moved up and down along the wall 34, so that also said wall 34 can be cut into pieces.

Although at least one person must be present in the oil storage tank for operating the device 1 that is shown in this embodiment, the device 1 may also be adapted for being operated by remote control, or a control programme may be used, so that the device 1 will automatically follow the correct path for achieving the desired result.

The invention claimed is:

1. A system for cutting steel plate, comprising:

at least one of a hydraulic and pneumatic pump; and a mobile cutting device including at least one of a hydraulic and pneumatic motor for driving the cutting device, wherein the pump and the motor are at least one of hydraulically and pneumatically interconnected via hoses, and wherein the cutting device is provided with means for moving the cutting device independently relative to the steel plate by way of said motor, and with means for controlling the direction of said movement by an operator with or without the aid of a remote control or a preprogrammed control program.

2. A system according to claim 1, wherein the cutting device includes at least one nozzle for squirting an abrasive liquid under high pressure against and through the plate.

3. A system according to claim 2, wherein the nozzle is supported by at least one wheel, which can travel over the steel plate.

4. A system according to claim 2, wherein the nozzle is spring-connected to the driven portion of the cutting device.

5. A system according to claim 2, wherein the cutting device is fitted with two spaced-apart nozzles, in such a manner that the cutting device is capable of cutting a strip from the steel plate in one movement.

6. A system according to claim 1, wherein the cutting device includes a container for an abrasive agent.

7. A system according to claim 1, wherein the cutting device is fitted with caterpillar tracks for moving the device.

8. A system according to claim 1, wherein the transmission ratio is such that the velocity of movement of the device will be less than 0.5 m/s, with at least one of an engine speed of about 3000 rpm and a hydraulic output of about 25 l/min.

9. A system according to claim 1, wherein the system is for cutting at least one of a bottom and a wall of an oil storage tank.

10. A system according to claim 3, wherein the nozzle is spring-connected to the driven portion of the cutting device.

11. A system according to claim 1, wherein the transmission ratio is such that the velocity of movement of the device will be less than 0.1 m/s, with at least one of an engine speed of about 3000 rpm and a hydraulic output of about 25 l/min.

12. A system according to claim 1, wherein the transmission ratio is such that the velocity of movement of the device will be less than 0.06 m/s, with at least one of an engine speed of about 3000 rpm and a hydraulic output of about 25 l/min.

13. A mobile cutting device for cutting steel plate, comprising:

at least one nozzle for squirting an abrasive liquid under high pressure against and through the plate; and a hydraulic and pneumatic motor for driving the cutting device;

means for moving the cutting device independently relative to the steel plate by way of said motor; and means for controlling the direction of said movement by an operator with or without the aid of a remote control or by a preprogrammed control program.

14. A cutting device according to claim 13, wherein said motor is at least one of a hydraulic and pneumatic motor, which is hydraulically or pneumatically connected to a separate hydraulic or pneumatic pump.

15. A cutting device according to claim 13, wherein the cutting device is for cutting at least one of a bottom and a wall of an oil storage tank.

16. A method using the cutting device of claim 13 for cutting at least one of a bottom and a wall of a storage tank, comprising:

independently moving the cutting device over the bottom of the storage tank by way of a motor during the cutting operation.

17. A method according to claim 16, wherein said cutting is effected by squirting an abrasive liquid under high pressure against and through at least one of the bottom and the wall.

18. A method according to claim 17, wherein said abrasive liquid contains at least one of sand and garnet.

19. A method according to claim 16, wherein the cutting device is hydraulically or pneumatically driven, to which end a hydraulic or pneumatic pump is disposed outside the storage tank, which pump is connected to the motor.

20. A method according to claim 16, wherein the cutting device abuts against the wall of the storage tank while moving through the storage tank, with the wall acting as a guide.

* * * * *